US009252533B2

(12) United States Patent
Wang

(10) Patent No.: US 9,252,533 B2
(45) Date of Patent: Feb. 2, 2016

(54) DATA CABLING JACK DEVICE AND DATA CABLING ASSEMBLY STRUCTURE

(71) Applicant: EMCOM TECHNOLOGY INC., Taipei (TW)

(72) Inventor: Chu-Li Wang, Taipei (TW)

(73) Assignee: EMCOM TECHNOLOGY INC., Taipei (TW)

( * ) Notice: Subject to any disclaimer, the term of this patent is extended or adjusted under 35 U.S.C. 154(b) by 40 days.

(21) Appl. No.: 14/135,575

(22) Filed: Dec. 19, 2013

(65) Prior Publication Data

US 2014/0179137 A1 Jun. 26, 2014

(30) Foreign Application Priority Data

Dec. 20, 2012 (CN) ..... 2012 2 0708368

(51) Int. Cl.

| | |
|---|---|
| ***H01R 13/627*** | (2006.01) |
| ***H01R 13/629*** | (2006.01) |
| ***H01R 13/639*** | (2006.01) |
| *H01R 13/518* | (2006.01) |

(52) U.S. Cl.

CPC ..... *H01R 13/629* (2013.01); *H01R 13/6273* (2013.01); *H01R 13/6395* (2013.01); *H01R 13/518* (2013.01)

(58) Field of Classification Search

CPC ..... H01R 13/6272; H01R 13/6275
USPC ..... 439/352, 353, 540.1, 719, 906, 596
See application file for complete search history.

(56) References Cited

U.S. PATENT DOCUMENTS 8,079,871 B2 * 12/2011 Ye ..... H01R 13/62 439/596
8,435,062 B2 * 5/2013 Lange ..... H01R 13/6272 439/350

* cited by examiner

*Primary Examiner* — Abdullah Riyami
*Assistant Examiner* — Thang Nguyen
(74) *Attorney, Agent, or Firm* — Cheng-Ju Chiang

(57) ABSTRACT

A data cabling jack device for configuring a plurality of cables on an assembly frame is provided. The data cabling jack device includes a housing and an engaging structure. The housing has an accommodation space, wherein the housing includes a jack side and a cable side opposite to the jack side. The engaging structure is disposed on the housing and has an engaging switch and an engaging portion, wherein the engaging switch is switched between a release position and an engaging position. The release position and the engaging position are respectively disposed nearby the cable side and the jack side. The engaging portion engages the assembly frame when the engaging switch is switched from the release position to the engaging position to drive the engaging portion to protrude out of the assembly frame.

21 Claims, 9 Drawing Sheets

DATA CABLING JACK DEVICE AND DATA CABLING ASSEMBLY STRUCTURE

BACKGROUND OF THE INVENTION

1. Field of the Invention

The present invention generally relates to a data cabling jack device and a data cabling assembly structure; particularly, the present invention relates to a data cabling jack device and a data cabling assembly structure which can increase assembly quality and improve jack structure.

2. Description of the Prior Art

In general, communication technology is continuously developed, and the density of data cables increases gradually, so that the manufacturers often develop connectors and frame systems thereof for constructing a suitable cable assembling system. For example, the cable structure has a connector and a plurality of cables, and the connector is configured on the frame system. In practical applications, the frame system can configure a plurality of cable structures, and the cable structure is disposed on the frame system.

In general, the conventional cable structure has an engaging structure, and the engaging structure can be directly engaged with the frame system while being configured on the frame system. However, configuration error sometimes happens when the technicians configure the cable structure on the frame system. Once configuration error happened, it takes additional time for reconfiguration to adjust the engaging structure from the engaging configuration to the release configuration, indirectly impacting the operation efficiency.

In addition, the conventional cables have various sizes of outer diameter; it immediately impacts the assembly process of the connector and the cables. For instance, if cables having different outer diameters are configured on a cable structure designed for one-size cable, it easily causes an over-tight or an over-loose configuration. Some manufacturers try to utilize screws or other fastening components to improve the connector; however, it not only increases the cost but also complicates the assembly process.

For the above reasons, it is desired to design a cable structure for increasing configuration compatibility and improving the assembly efficiency.

SUMMARY OF THE INVENTION

In view of prior arts, the present invention provides a data cabling jack device and a data cabling assembly structure which can increase assembly quality and improve the configuration of cables.

It is an object of the present invention to provide a data cabling jack device and a data cabling assembly structure to increase assembly quality.

It is another object of the present invention to provide a data cabling jack device and a data cabling assembly structure which can bear cables to increase configuration compatibility.

It is another object of the present invention to provide a data cabling jack device and a data cabling assembly structure to improve assembly structure.

The present invention provides a data cabling jack device for configuring a plurality of cables on an assembly frame. The data cabling jack device includes a housing and an engaging structure. The housing has an accommodation space, wherein the housing includes a jack side and a cable side opposite to the jack side. The engaging structure is disposed on the housing and has an engaging switch and an engaging portion, wherein the engaging switch is switched between a release position and an engaging position, the release position and the engaging position are respectively disposed nearby the cable side and the jack side. The engaging portion engages the assembly frame when the engaging switch is switched from the release position to the engaging position to drive the engaging portion protruding out of the assembly frame.

In another embodiment, the present invention provides a data cabling assembly structure including an assembly structure, a plurality of cables, and a data cabling jack device, wherein the assembly frame has a plurality of engaging holes, each cable has an electrical end. In addition, a plurality of engaging portions of the data cabling jack device are engaged on the corresponding engaging holes, and the electrical end of each cable is inserted into the accommodation space from the cable end, and the cables are disposed on the accommodation space.

Compared to prior arts, the data cabling jack device and the data cabling assembly structure of the present invention utilize the engaging switch to control the connecting relation between the housing and the engaging portion, controlling the engaging switch to be switched between the release position and the engaging position, further determining if the data cabling jack device is engaged on the assembly frame. In practical applications, when the housing is disposed on the assembly frame, the housing is not directly engaged with the assembly frame and needs to switch the engaging switch to control the data cabling jack device to be engaged with the assembly frame, so as to avoid generating additional assembly hours due to configuration error and increase assembly efficiency.

The above and other objects, features and advantages of the present invention will be more clearly understood from the following detailed description taken in conjunction with the accompanying drawings.

A data cabling jack device of the present invention for configuring a plurality of cables on an assembly frame includes a housing having an accommodation space, wherein the housing includes a jack side and a cable side opposite to the jack side; and an engaging structure disposed on the housing and having an engaging switch and an engaging portion, wherein the engaging switch is switched between a release position and an engaging position, the release position and the engaging position are respectively disposed nearby the cable side and the jack side; the engaging portion engages the assembly frame when the engaging switch is switched from the release position to the engaging position to drive the engaging portion protruding out of the assembly frame.

In one embodiment of the data cabling jack device of the present invention, the engaging portion is a hook and disposed on an engaging groove of the housing; when the engaging switch is located at the releasing position, the hook is accommodated in the engaging groove; when the engaging switch is located at the engaging position, the hook protrudes out of the engaging groove.

In one embodiment of the data cabling jack device of the present invention, the engaging switch has a first plane and a second plane; the first plane includes a switch end, the second plane includes a propulsion end, and the first plane and the second plane are disposed on different planes and involve a spacing; the switch end is exposed in an exterior operation space of the housing, and the propulsion end corresponds to the engaging portion and is disposed in the engaging groove.

In one embodiment of the data cabling jack device of the present invention, when the engaging switch is switched from the release position to the engaging position and is propelled to approach the jack side, the propulsion end pushes the engaging portion to extend out of the engaging groove.

In one embodiment of the data cabling jack device of the present invention, when the engaging switch is switched from the engaging position to the release position and moves toward the cable side, the engaging portion retracts back to the engaging groove and stops engaging the assembly frame.

In one embodiment of the data cabling jack device of the present invention, the housing includes a top housing and a bottom housing, wherein the top housing closes the bottom housing to form the accommodation space.

The data cabling jack device of the present invention further includes at least one shaft disposed on one end of the bottom housing adjacent to the jack side; and at least one shaft hole, wherein the at least one shaft hole corresponds to the at least one shaft and is disposed on one end of the top housing adjacent to the jack side, and the top housing and the bottom housing pivotally open or close with the shafts as the pivotal center.

In one embodiment of the data cabling jack device of the present invention, the top housing includes at least one first engaging portion disposed close to one end at the cable side.

In one embodiment of the data cabling jack device of the present invention, the bottom housing includes at least one second engaging portion that corresponds to the at least one first engaging portion and is disposed close to one end at the cable side, wherein the at least one engaging portion and the at least one second engaging portion are engaged to each other when the top housing and the bottom housing pivotally close.

In one embodiment of the data cabling jack device of the present invention, the housing includes at least one supporting holder disposed on the accommodation space, wherein each supporting holder has a suspension arm and a holder connecting the suspension arm. The holder is connected with a suspension end of the suspension arm, and the suspension arm is bent to extend out from an inner bottom surface of the housing to form the holder on the suspension end.

In one embodiment of the data cabling jack device of the present invention, the holder has an arc surface, and the arc surface of the holder faces and bears the cables.

In one embodiment of the data cabling jack device of the present invention, the housing further includes at least one clamping portion disposed across the at least one supporting holder, wherein the at least one clamping portion has a plurality of arc grooves corresponding to the holder, and the plurality of arc grooves and the holder together clamp the cables.

In one embodiment of the data cabling jack device of the present invention, two ends of the at least one clamping portion are connected with the inner bottom surface.

In one embodiment of the data cabling jack device of the present invention, the at least one clamping portion is disposed on an inner top surface of the housing.

In one embodiment of the data cabling jack device of the present invention, the bending degree of the suspension arm from the inner bottom surface depends on an outer diameter of each cable.

The data cabling jack device of the present invention further includes a plurality of jacks disposed on the jack side of the housing in a row along a transverse direction, wherein the cables are disposed in the accommodation space and respectively connected with the jacks.

In one embodiment of the data cabling jack device of the present invention, the jacks are disposed on the jack side in a matrix, so that the cables are disposed in the accommodation space in a matrix.

A data cabling jack device of the present invention for configuring a plurality of cables on an assembly frame includes a top housing and a bottom housing, wherein the top housing closes the bottom housing to form an accommodation space, the bottom housing includes a jack side and a cable side opposite to the jack side; an engaging structure disposed on the top housing and having an engaging switch and an engaging portion, wherein the engaging switch is switched between a release position and an engaging position, the release position and the engaging position are respectively disposed nearby the cable side and the jack side; the engaging portion engages the assembly frame when the engaging switch is switched from the release position to the engaging position to drive the engaging portion protruding out of the top housing; at least one shaft disposed on one end of the bottom housing adjacent to the jack side; and at least one shaft hole, wherein the at least one shaft hole, which corresponds to the at least one shaft and is disposed on one end of the top housing adjacent to the jack side, and the top housing and the bottom housing pivotally open or close with the shafts as the pivotal center.

A data cabling jack device of the present invention for configuring a plurality of cables on an assembly frame, including: a top housing and a bottom housing, wherein the top housing closes the bottom housing to form an accommodation space, the bottom housing includes a jack side and a cable side opposite to the jack side and includes: at least one supporting holder disposed on the accommodation space, wherein each supporting holder has a suspension arm and a holder connecting the suspension arm, the holder is connected with a suspension end of the suspension arm, and the suspension arm is bent to extend out from an inner bottom surface of the bottom housing to form the holder on the suspension end; an engaging structure disposed on the top housing and having an engaging switch and an engaging portion, wherein the engaging switch is switched between a release position and an engaging position, the release position and the engaging position are respectively disposed nearby the cable side and the jack side; the engaging portion engages the assembly frame when the engaging switch is switched from the release position to the engaging position to drive the engaging portion protruding out of the top housing; at least one shaft disposed on one end of the bottom housing adjacent to the jack side; and at least one shaft hole, wherein the at least one shaft hole, which corresponds to the at least one shaft and is disposed on one end of the top housing adjacent to the jack side, and the top housing and the bottom housing pivotally open or close with the shaft as the pivotal center.

A data cabling assembly structure includes: an assembly frame having a plurality of engaging holes; a plurality of cables, wherein each cable has an electrical end; and the data cabling jack device as described above, wherein the engaging portions are engaged on the corresponding engaging holes; the electrical end of each cable is inserted into the accommodation space from the cable end, and the cables are disposed on the accommodation space.

In one embodiment of the data cabling assembly structure of the present invention, the cables are disposed on the accommodation space in a matrix.

DETAILED DESCRIPTION OF THE PREFERRED EMBODIMENT

According to one embodiment of the present invention, a data cabling jack device and a data cabling assembly structure which can increase assembly efficiency are provided.

Figure 1A:
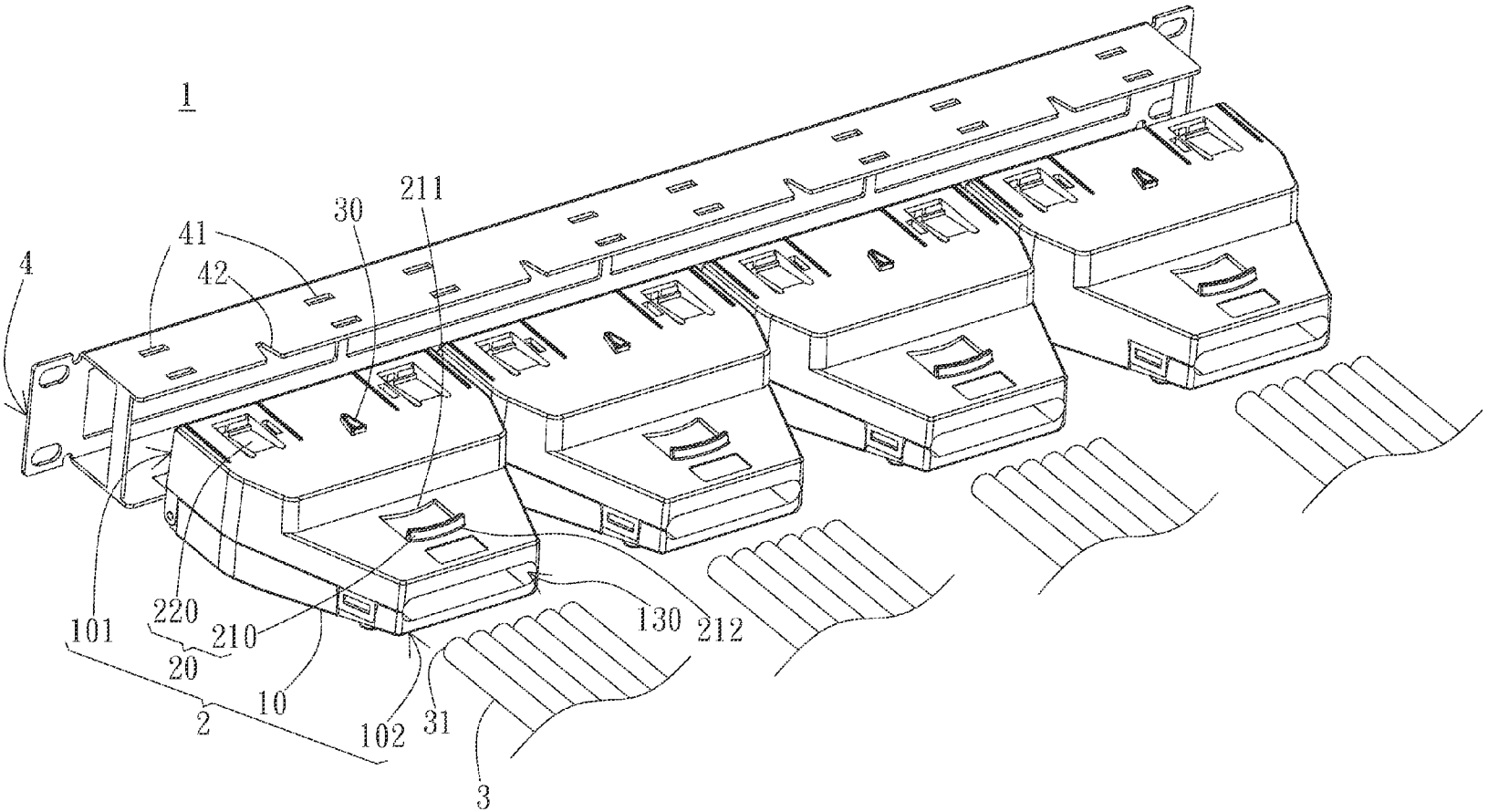
FIG. 1A is a schematic view of an embodiment of a data cabling jack device and a data cabling assembly structure of the present invention.

Please refer to FIG. 1A; FIG. 1A is a schematic view of an embodiment of a data cabling jack device and a data cabling assembly structure of the present invention. As shown in FIG. 1A, a data cabling assembly 1 includes a data cabling jack device 2, a plurality of cables 3, and an assembly frame 4, wherein the assembly frame 4 has a plurality of engaging holes 41. Each cable 3 has an electrical end 31. In practical applications, the data cabling jack device 2 is used for configuring the cables 3 on the assembly frame 4 and includes a housing 10 and an engaging structure 20. The housing 10 has an accommodation space 130, wherein the housing 10 includes a jack side 101 and a cable side 102 opposite to the jack side 101. In addition, the electrical end 31 of each cable 3 is inserted into the accommodation space 130 from the cable side 102, and the cables 3 are disposed along the accommodation space 130 in a row. As shown in FIG. 1A, the engaging structure 20 is disposed on the housing 10 and has an engaging switch 210 and an engaging portion 220, wherein the engaging switch 210 is switched between a release position 212 and an engaging position 211. The release position 212 and the engaging position 211 are respectively disposed nearby the cable side 102 and the jack side 101.

Figure 1B:
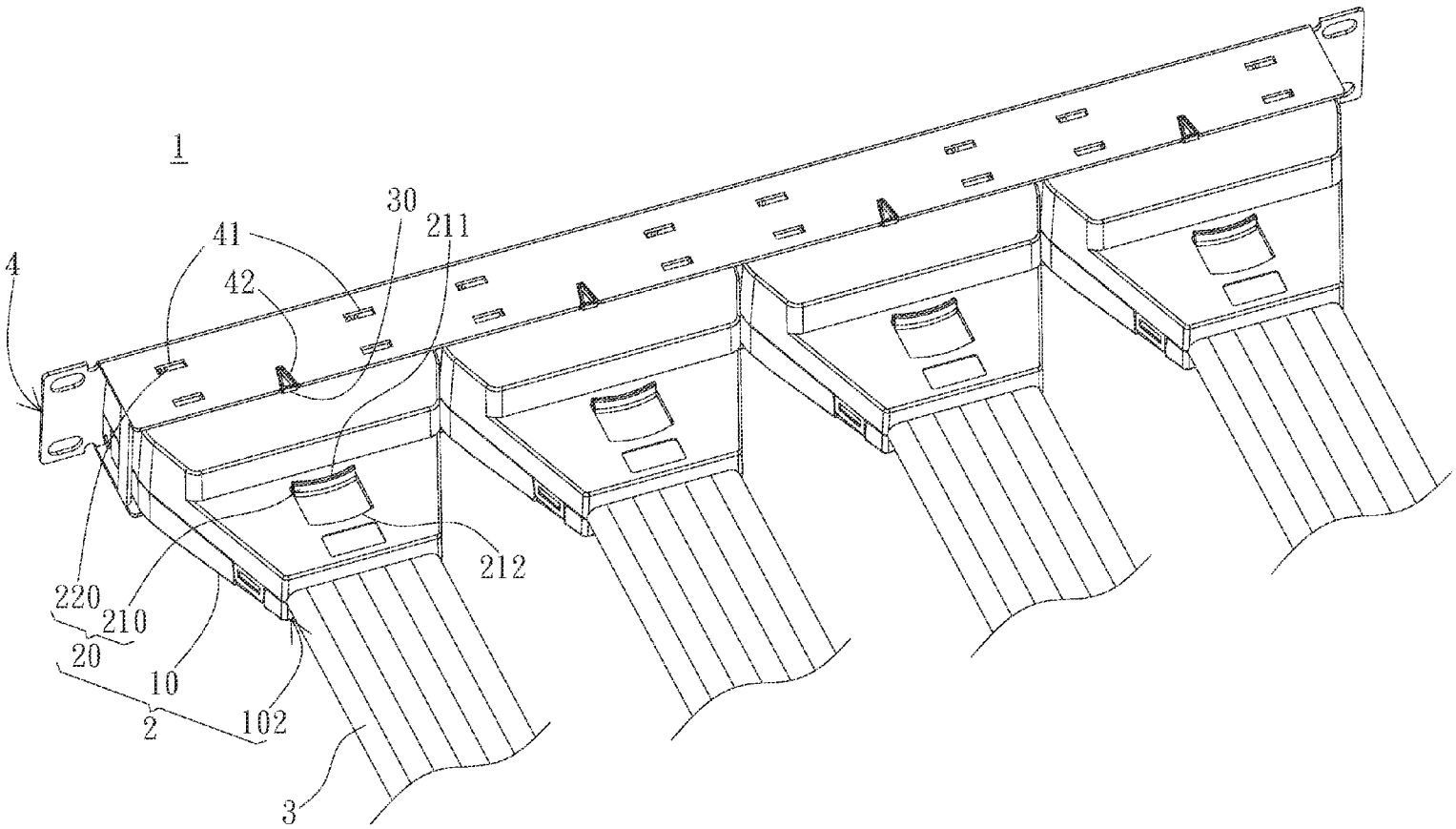
FIG. 1B is a schematic view of the embodiment of the data cabling jack device and the data cabling assembly structure of the present invention.

For instance, please refer to FIGS. 1A and 1B, wherein FIG. 1B is a schematic view of the embodiment of the data cabling jack device and the data cabling assembly structure of the present invention. As shown in FIGS. 1A and 1B, the engaging switch 210 in FIG. 1A is located at the release position 212, and the engaging switch 210 in FIG. 1B is located at the engaging position 211.

In the embodiment, the engaging portion 220 engages the assembly frame 4 when the engaging switch 210 is switched from the release position 212 to the engaging position 211 to drive the engaging portion 220 protruding out of the housing 10. In particular, the engaging portions 220 are engaged on the corresponding engaging holes 41. In other words, the engaging hole 41 is a through-hole, and the engaging portion 220 can be a hook, a column, or other engaging components.

In addition, the data cabling jack device 2 further has an alignment portion 30, and the assembly frame 4 has a plurality of alignment holes 42, wherein the alignment portion 30 protrudes on the housing 10 and used for aligning the alignment hole 42 of the assembly frame 4. In the embodiment, the alignment hole 42 is a triangular recess formed on the edge of the assembly frame 4 and is preferably disposed on a central line between two adjacent engaging holes 41. The alignment portion 30 is a bulge formed on the housing 10, but not limited to the embodiment. For instance, as shown in FIG. 1B, when the data cabling jack device 2 is assembled on the assembly frame 4, the alignment portion 30 is aligned with the alignment hole 42, so that the engaging portion 220 can be aligned with the engaging hole 41. In addition, the two engaging portions 220 are disposed on the housing in a symmetrical manner with respect to the alignment portion 30, but not limited thereto.

Figure 2A:
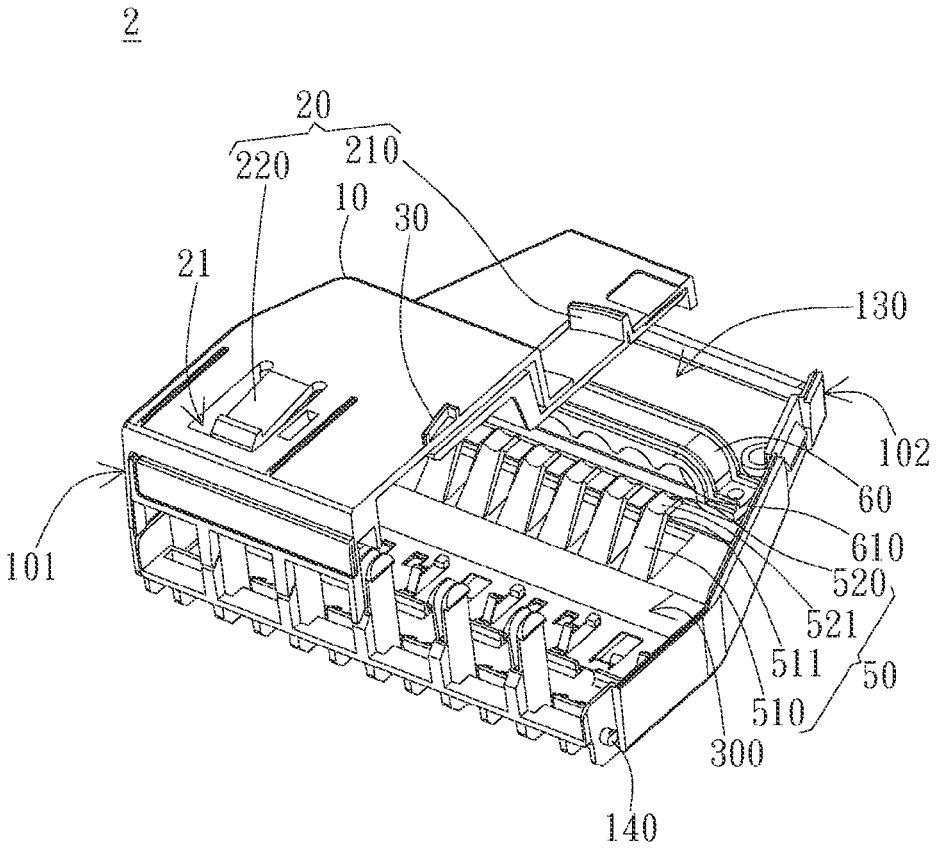
FIG. 2A is a sectional view of the embodiment of the data cabling jack device of the present invention.
Figure 2B:
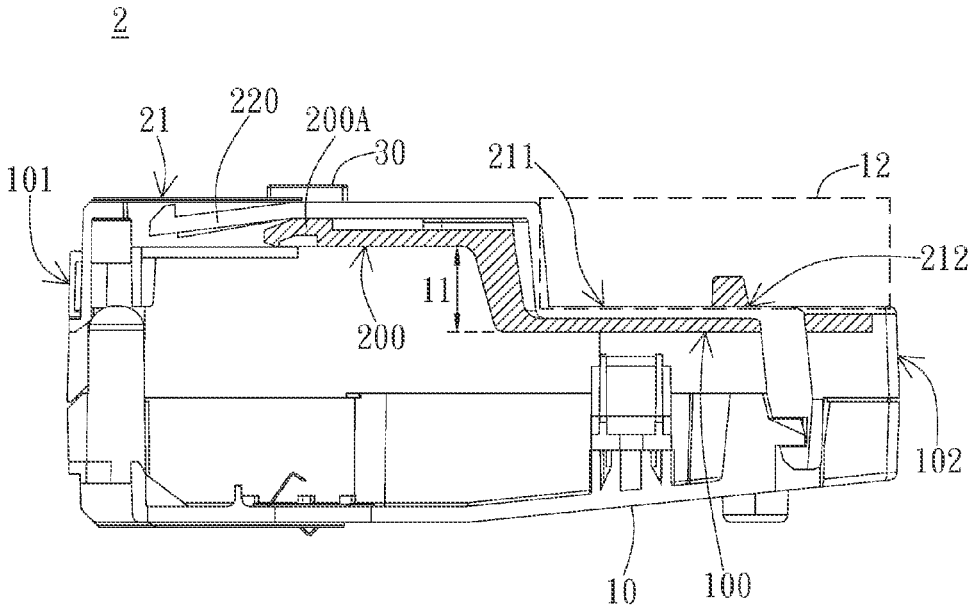
FIG. 2B is a sectional view at a side of the embodiment of the data cabling jack device of the present invention.

Furthermore, please refer to FIGS. 2A and 2B; FIG. 2A is a sectional view of the embodiment of the data cabling jack device of the present invention; FIG. 2B is a sectional view from one side of the embodiment of the data cabling jack device of the present invention. As shown in FIG. 2A, the engaging portion 220 is a hook and disposed on an engaging groove 21 of the housing 10. In practical application, when the engaging switch 210 is located at the releasing position 212, the hook (the engaging portion 220) is accommodated in the engaging groove 21, as shown in FIG. 2B. In addition, as shown in FIG. 1B, when the engaging switch 210 is located at the engaging position 211, the hook (the engaging portion 220) protrudes out of the engaging groove 21, as shown in FIG. 2C.

Figure 2C:
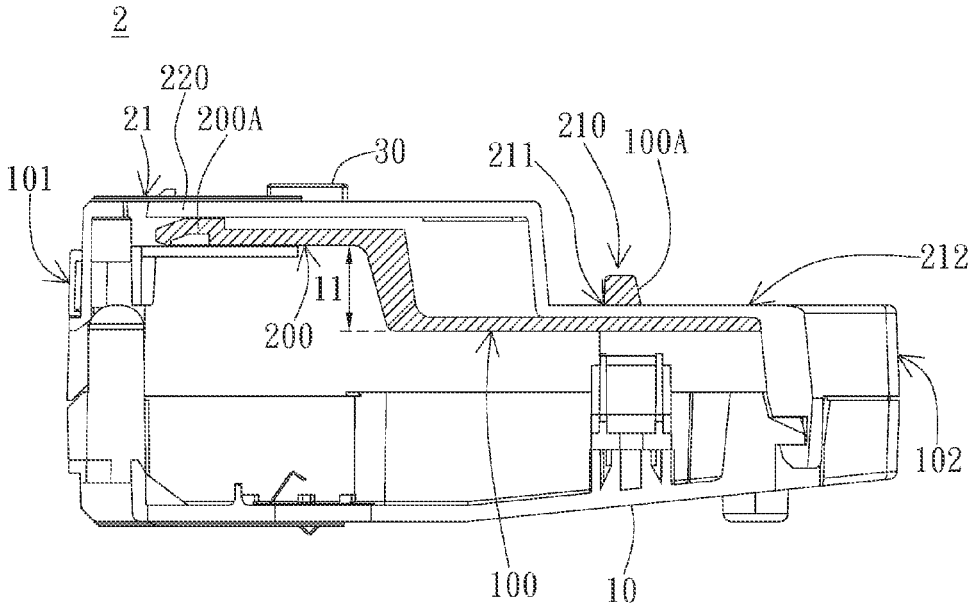
FIG. 2C is a sectional view at a side of the embodiment of the data cabling jack device of the present invention.
Figure 3:
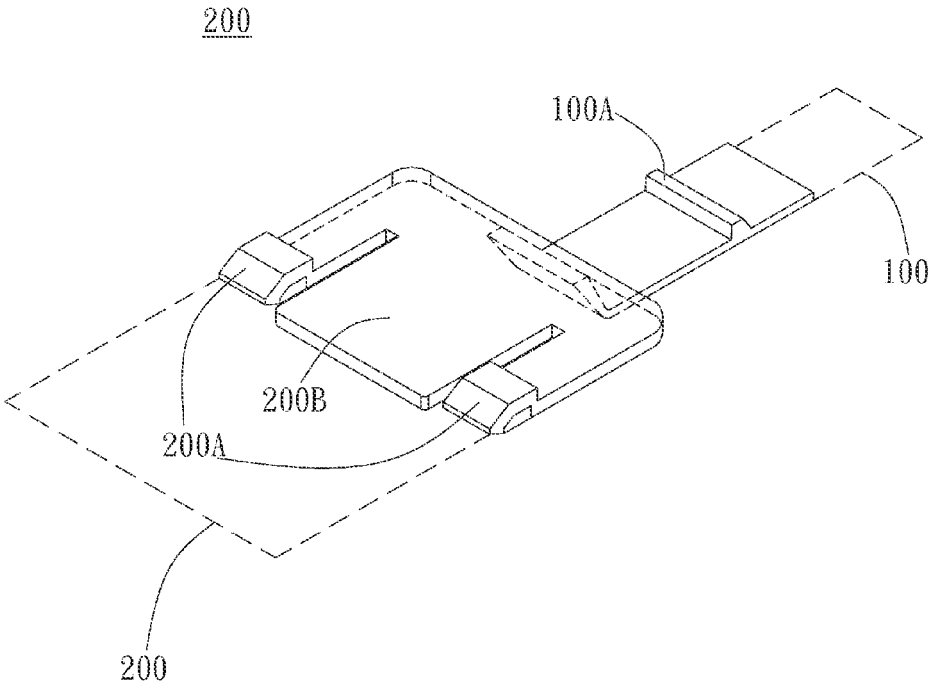
FIG. 3 is a schematic view of an embodiment of the engaging switch of the present invention.

FIG. 3 is a schematic view of an embodiment of the engaging switch of the present invention. As shown in FIG. 2C, the engaging switch 210 has a first plane 100 and a second plane 200. The first plane 100 includes a switch end 100A; the second plane 200 includes a propulsion end 200A and a guide portion 200B. The first plane 100 and the second plane 200 are disposed on different planes and involve a spacing 11 (shown in FIGS. 2B and 2C). In the embodiment, compared with the first plane 100, the second plane 200 is nearer the engaging portion 220, and the engaging portion 200 is preferably close to the second plane 200. In addition, as shown in FIGS. 2A and 2B, the switch end 100A is exposed in an exterior operation space 12 of the housing 10, and the propulsion end 200A corresponds to the engaging portion 220 and is disposed in the engaging groove 21. In practical applications, the guide portion 200B can assist in guiding the propulsion end 200A to move in the accommodation space 130 so as to increase the rigidity of the physical structure.

Please refer to FIG. 2C; FIG. 2C is a sectional view from one side of the embodiment of the data cabling jack device of the present invention. As shown in FIG. 2C, when the engaging switch 210 is switched from the release position 212 to the engaging position 211 and is propelled to approach the jack side 101, the propulsion end 200A pushes the engaging portion 220 to extend out of the engaging groove 21. In addition, when the engaging switch 210 is switched from the engaging position 211 to the release position 212 and moves toward the cable side 102, the engaging portion 220 retracts back to the engaging groove 21 and stops engaging the assembly frame 4.

In practical applications, when the user assembles the data cabling jack device with the assembly frame 4, the data cabling jack device 2 is originally not engaged with the assembly frame 4 and the user needs to switch the engaging switch 210 to determine whether to engage the data cabling jack device 2 with the assembly frame 4 or not so as to complete the assembly of the data cabling jack device 2 with the assembly frame 4. It is noted that the engaging portion 220, according to the engaging switch 210 is located at the engaging position 211 or the release position 212, determines whether the data cabling jack device 2 is engaged with the assembly frame 4 so as to improve assembly efficiency.

In addition, in the embodiment, the data cabling jack device 2 utilizes the propulsion end 200A of the engaging switch 210 as a supporting holder of the engaging portion 220, so that the engaging portion 200 engaged with the assembly frame 4 has a physical support. As shown in FIG. 2C, the propulsion end 200A supports the engaging portion 220, further increasing the engaging relation between the data cabling jack device 2 and the assembly frame 4 so as to achieve a better assembly effect. Compared to the conventional jack utilizing an elastic component as the engaging portion, the elastic component easily rebounds or shrinks so as to generate assembly error or engagement error. On the contrary, the propulsion end 200A is treated as the supporting holder of the engaging portion 220, strengthening the rigidity of the engaging portion 220 so as to increase the engaging degree between structures.

Figure 4A:
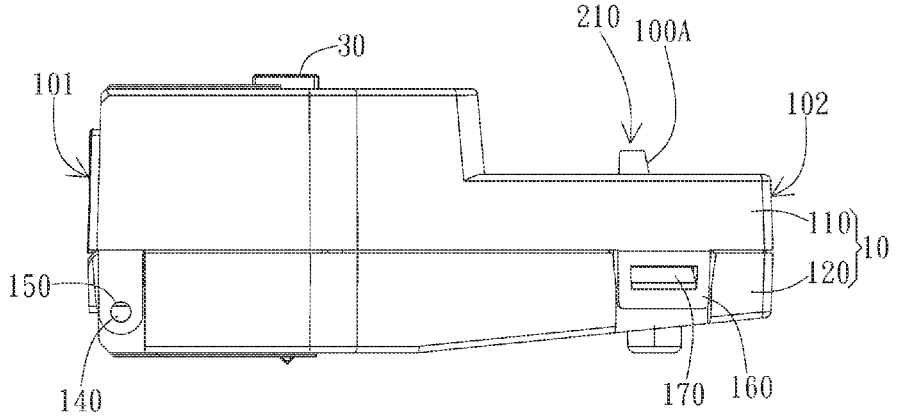
FIG. 4A is schematic view of the embodiment of the data cabling jack devices of the present invention.
Figure 4B:
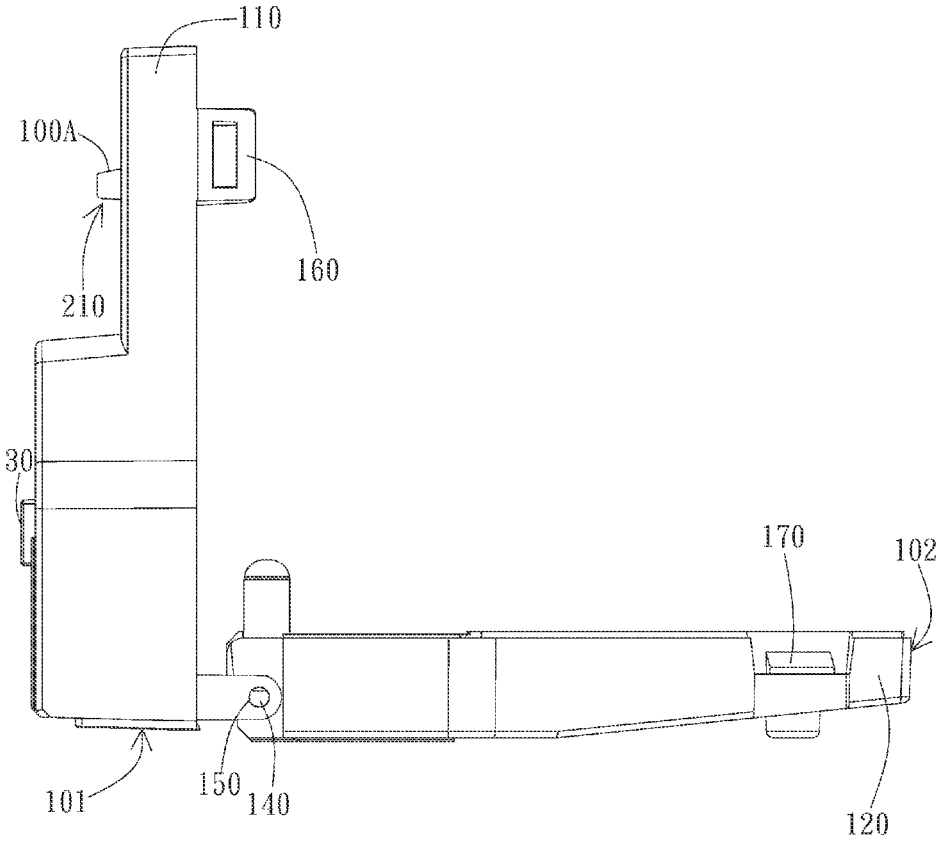
FIG. 4B is schematic view of the embodiment of the data cabling jack devices of the present invention.

Please refer to FIGS. 4A and 4B; FIGS. 4A and 4B are respectively schematic views of the embodiments of the data cabling jack devices of the present invention. As shown in FIG. 4A, the housing 10 of the data cabling jack device includes a top housing 110 and a bottom housing 120. As shown in FIGS. 2A and 4A, the top housing 110 closes the bottom housing 120 to form the accommodation space 130.

In the embodiment, the data cabling jack device 2 further includes at least two shafts 140 and at least two shaft holes 150. As shown in FIG. 2A, the shafts 140 are respectively disposed on (two opposite ends of) the bottom housing 120 (adjacent to the jack side 101). In the embodiment, the data cabling jack device 2 has two shafts 140, and each shaft 140 protrudes on the bottom housing 120. Please refer to FIGS. 4A and 4B, the shaft holes 150 respectively correspond to the shafts 140 and are disposed on two opposite ends of the top housing 110 adjacent to the jack side 101, so that the top housing 110 and the bottom housing 120 pivotally open or close with the shaft 140 as a pivotal center. For instance, the top housing 110 and the bottom housing 120 in FIG. 4A are in a closed configuration, and the top housing 110 and the bottom housing 120 in FIG. 4B are in an open configuration.

In the embodiment, the top housing 110 includes at least two first engaging portions 160, and the bottom housing 120 includes at least two second engaging portions 170. As shown in FIGS. 4A and 4B, the first engaging portions 160 are disposed close to two opposite ends at the cable side 102. In addition, the second engaging portions 170 correspond to the first engaging portions 160 and are respectively disposed close to two opposite ends at the cable side 102. In the embodiment, the top housing 110 has two first engaging portions 160, and the bottom housing 120 has two second engaging portions 170, but the number of engaging portions may be less or more than two and is not limited to the embodiment. The first engaging portions 160 and the second engaging portions 170 are engaged to each other when the top housing 110 and the bottom housing 120 pivotally close.

In addition, the first engaging portion 160 is a through-hole, and the second engaging portion 170 is a hook or a snap. In other words, the bottom housing 120 utilizes the second engaging portion 170 engaging with the first engaging portion 160 to further engage with the top housing 110, but not limited to the embodiment. In other embodiments, the data cabling jack device 2 merely has one first engaging portion 160 and one second engaging portion 170. The first engaging portion 160 and the second engaging portion 170 are respectively disposed on a corresponding side of the top housing 110 and the bottom housing 120, but not limited thereto.

In practical applications, the user can change the cables 3 or operate other assembly process by releasing the engaging status between the first engaging portion 160 and the second engaging portion 170. In other words, the first engaging portion 160 and the second engaging portion 170 can simplify the assembly structure of the housing 10 to decrease the working time for users to assemble or disassemble the top housing 110 and the bottom housing 120 so as to increase assembly efficiency.

Please refer to FIG. 2A; FIG. 2A is the schematic view of the embodiment of the data cabling jack device of the present invention. As shown in FIG. 2A, the housing 10 includes at least one supporting holder 50, wherein the supporting holder 50 is disposed in the accommodation space 130. Each supporting holder 50 has a suspension arm 510 and a holder 520 connecting the suspension arm 510. The holder 520 is connected with a suspension end 511 of the suspension arm 510, and the suspension arm 510 is bent to extend out from an inner bottom surface 300 of the housing 10 to form the holder 520 on the suspension end 511. It is noted that the holder 520 has an arc surface 521, and the arc surface 521 of the holder 520 faces and bears the cables 3.

In addition, the housing 10 further includes at least one clamping portion 60, wherein the clamping portion 60 is disposed across the supporting holders 50. Each clamping portion 60 has a plurality of arc grooves 610 corresponding to the holder 520. The plurality of arc grooves 610 and the holder 520 together clamp the cables 3. In the embodiment, two ends of the clamping portion 60 are connected with the inner bottom surface 300 by, for example, screws or other fastening elements. It is noted that the bending degree of the suspension arm 510 from the inner bottom surface 300 depends on the outer diameter of the cable 3. In practical applications, the suspension arm 510 can be an elastic component which can generate deformation and can be plastics, metal components, or other elastic components, not limited thereto.

In other words, when the clamping portion 60 is fixed on the inner bottom surface 300, the arc groove 610 of the clamping portion 60 constrains the position of the top surface of the cable 3. In addition, if the cable 3 has a larger external diameter, the clamping portion 60 and the cable apply a force to the supporting holder 50, so that the suspension arm 510 is bent and has a larger obtuse angle with the inner bottom surface 300. On the contrary, if the cable 3 has a less external diameter, the clamping portion 60 and the cable 3 apply a less force or no force to the supporting holder 50, so that the suspension arm 510 is bent slightly or is not bent and has a less obtuse angle with the inner bottom surface 300. Furthermore, the supporting holder 50 can increase the compatibility between the cables 3 and the data cabling jack device 2 so as to increase assembly quality and effectively decrease the cost.

Figure 5:
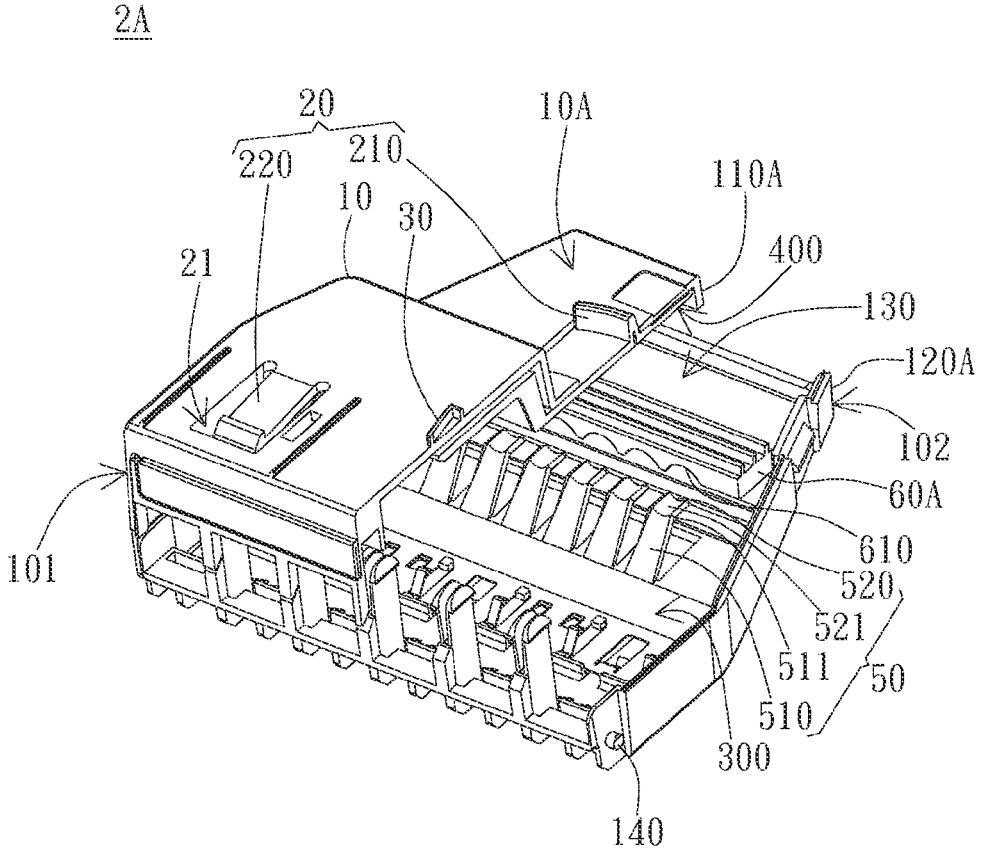
FIG. 5 is a schematic view of another embodiment of a data cabling jack device of the present invention.

Please refer to FIG. 5; FIG. 5 is a schematic view of another embodiment of a data cabling jack device of the present invention. As shown in FIG. 5, the clamping portion 60A of the data cabling jack device 2A is disposed on the inner top surface 400 of the housing 10A. In practical applications, when the top housing 110A is engaged with the bottom housing 120A, the top housing 110A causes the clamping portion 60A and the holder 520 of the supporting holder 50 together clamping the cable 3. In other words, the cable 3 is fastened while assembling the housing 10A so as to simplify assembly process and increase assembly efficiency.

Figure 6:
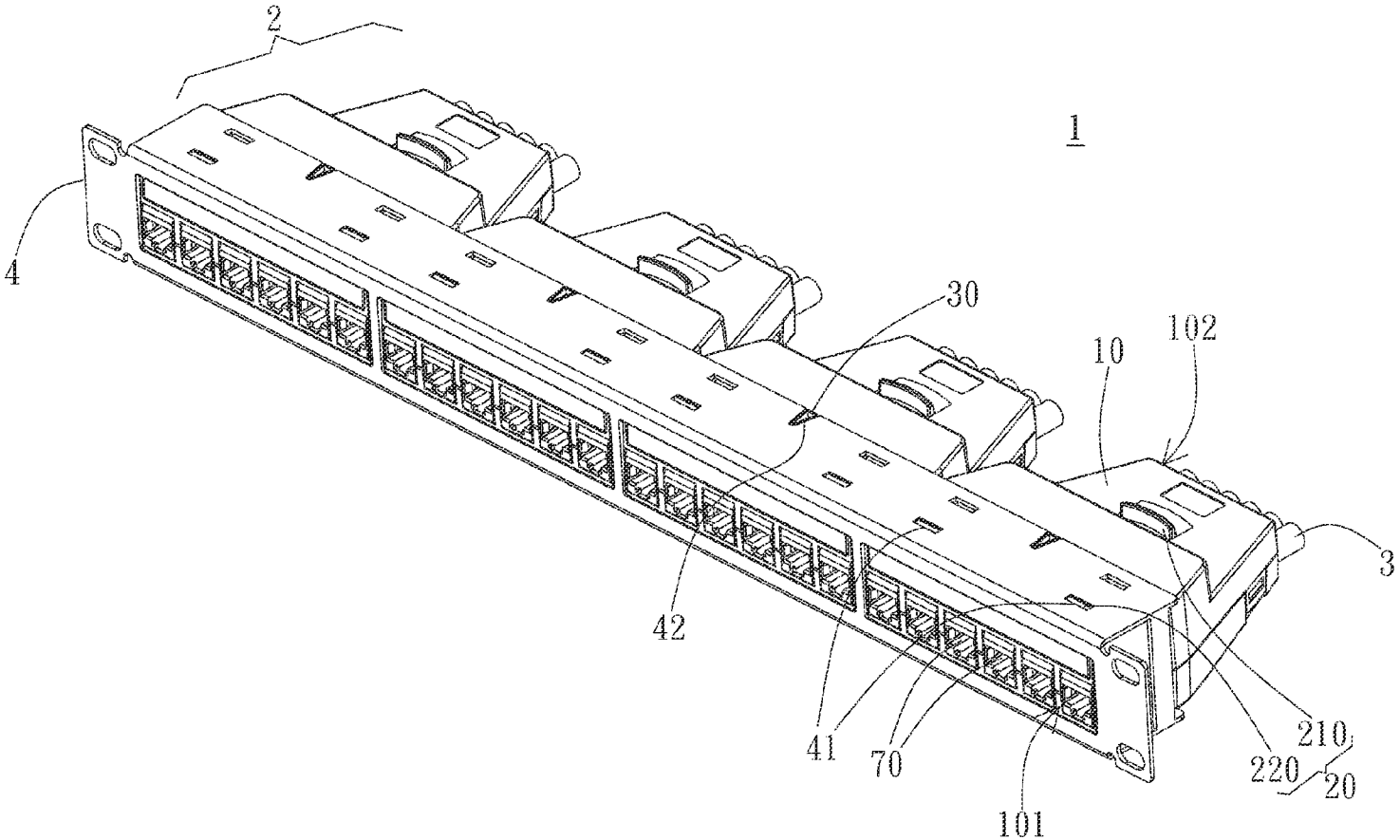
FIG. 6 is a schematic view of a data cabling assembly structure and a data cabling jack device of the present invention.

Please refer to FIG. 6; FIG. 6 is a schematic view of a data cabling assembly structure and a data cabling jack device of the present invention. As shown in FIG. 6, the data cabling jack device 2 further includes a plurality of jacks 70, wherein the jacks 70 are disposed on the jack side 101 of the housing 10 in a row along a transverse direction. The cables 3 are disposed in the accommodation space 130 and respectively connected with the jacks 70. In addition, in the same data cabling jack device 2, the amount of the jacks 70 is preferably the same as the amount of the cables 3. In practical applications, the user can utilize electrical elements connecting the jacks 70 to electrically connect the cables 3.

Figure 7:
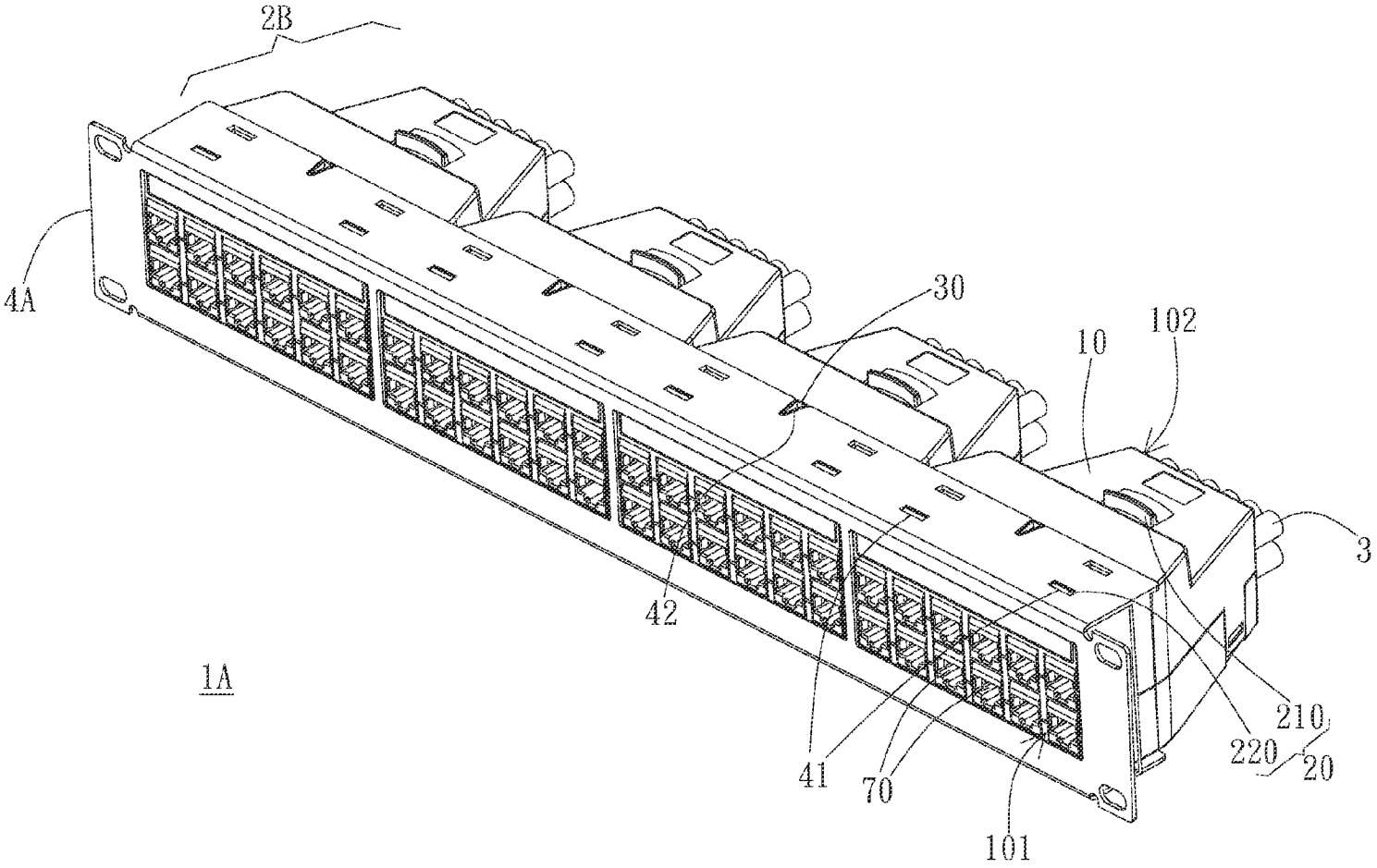
FIG. 7 is a schematic view of another embodiment of a data cabling jack device and a data cabling assembly structure of the present invention.

Please refer to FIG. 7; FIG. 7 is a schematic view of another embodiment of a data cabling jack device and a data cabling assembly structure of the present invention. As shown in FIG. 7, the data cabling assembly structure 1A includes an assembly frame 4A, a data cabling jack device 2B, and the cables 3. It is noted that the jacks 70 of the data cabling jack device 2B are disposed on the jack side 101 in a matrix, so that the cables 3 are disposed in the accommodation space 130 in a matrix. In the embodiment, each data cabling jack device 2B has twelve jacks 70 and twelve cables 3, wherein six jacks 70 are disposed in a row, and the jacks 70 are disposed on the jack side 101 of the data cabling jack device 2B in two rows. In practical applications, compared to the data cabling jack device 2, the data cabling jack device 2B can contain more cables 3 and jacks 70 and can be applied to a larger cabling system. In other embodiments, the data cabling jack device 2B can have more than two rows of jack 70, such as three rows or more, wherein the jacks 70 are disposed on the jack side 101 in a matrix, not limited to the embodiment.

Compared to prior arts, the data cabling jack device and the data cabling assembly structure of the present invention utilize the engaging switch to control the connecting relation between the housing and the engaging portion, controlling the engaging switch to be switched between the release position and the engaging position, further determining if the data cabling jack device is engaged on the assembly frame. In practical applications, when the housing is disposed on the assembly frame, the housing is originally not engaged with the assembly frame and requires switching the engaging switch to control the data cabling jack device to be engaged with the assembly frame so as to avoid generating additional assembly hours due to wrong configuration and increase assembly efficiency.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A data cabling jack device for configuring a plurality of cables on an assembly frame, comprising:

a housing having an accommodation space, wherein the housing comprises a jack side and a cable side opposite to the jack side; and an engaging structure disposed on the housing and having an engaging switch and an engaging portion, wherein the engaging switch is switched between a release position and an engaging position, the release position and the engaging position are respectively disposed nearby the cable side and the jack side; the engaging portion engages the assembly frame when the engaging switch is switched from the release position to the engaging position to push and support the engaging portion protruding out of the housing at a side of the engaging portion opposite to the assembly frame.

2. The data cabling jack device of claim 1, wherein the engaging portion is a hook and disposed on an engaging groove of the housing; when the engaging switch is located at the releasing position, the hook is accommodated in the engaging groove; when the engaging switch is located at the engaging position, the hook protrudes out of the engaging groove.

3. The data cabling jack device of claim 2, wherein the engaging switch has a first plane and a second plane, the first plane comprises a switch end, the second plane comprises a propulsion end, and the first plane and the second plane are disposed on different planes and involve a spacing; the switch end is exposed in an exterior operation space of the housing, and the propulsion end corresponds to the engaging portion and is disposed in the engaging groove.

4. The data cabling jack device of claim 3, wherein when the engaging switch is switched from the release position to the engaging position and is propelled to approach the jack side, the propulsion end pushes the engaging portion to extend out of the engaging groove.

5. The data cabling jack device of claim 3, wherein when the engaging switch is switched from the engaging position to the release position and moves toward the cable side, the engaging portion retracts back to the engaging groove and stops engaging the assembly frame.

6. The data cabling jack device of claim 1, the housing comprising:

a top housing; and a bottom housing, wherein the top housing closes the bottom housing to form the accommodation space.

7. The data cabling jack device of claim 6, further comprising:

at least one shaft disposed on one end of the bottom housing adjacent to the jack side; and at least one shaft hole, wherein the at least one shaft hole, which corresponds to the at least one shaft and is disposed on one end of the top housing adjacent to the jack side, and the top housing and the bottom housing pivotally open or close with the at least one shaft as the pivotal center.

8. The data cabling jack device of claim 6, wherein the top housing comprises:

at least one first engaging portion disposed close to one end at the cable side.

9. The data cabling jack device of claim 8, wherein the bottom housing comprises:

at least one second engaging portion, corresponding to the at least one first engaging portion and disposed close to one end at the cable side, wherein the at least one first engaging portion and the at least one second engaging portion are engaged to each other when the top housing and the bottom housing pivotally close.

10. The data cabling jack device of claim 1, wherein the housing comprises:

at least one supporting holder disposed on the accommodation space, wherein each supporting holder has a suspension arm and a holder connecting the suspension arm, the holder is connected with a suspension end of the suspension arm, and the suspension arm is bent to extend out from an inner bottom surface of the housing to form the holder on the suspension end.

11. The data cabling jack device of claim 10, wherein the holder has an arc surface, and the arc surface of the holder faces and bears the cables.

12. The data cabling jack device of claim 11, wherein the housing comprises:

at least one clamping portion disposed across the at least one supporting holder, wherein the at least one clamping portion has a plurality of arc grooves corresponding to the holder, and the plurality of arc grooves and the holder together clamp the cables.

13. The data cabling jack device of claim 12, wherein two ends of the at least one clamping portion are connected with the inner bottom surface.

14. The data cabling jack device of claim 12, wherein the at least one clamping portion is disposed on an inner top surface of the housing.

15. The data cabling jack device of claim 10, wherein the bending degree of the suspension arm from the inner bottom surface depends on an outer diameter of each cable.

16. The data cabling jack device of claim 1, further comprising:

a plurality of jacks disposed on the jack side of the housing in a row along a transverse direction, wherein the cables are disposed in the accommodation space and respectively connected with the jacks.

17. The data cabling jack device of claim 16, wherein the jacks are disposed on the jack side in a matrix, so that the cables are disposed on the accommodation space in a matrix.

18. A data cabling jack device for configuring a plurality of cables on an assembly frame, comprising:

a top housing and a bottom housing, wherein the top housing closes the bottom housing to form an accommodation space, the bottom housing comprises a jack side and a cable side opposite to the jack side;

an engaging structure disposed on the top housing and having an engaging switch and an engaging portion, wherein the engaging switch is switched between a release position and an engaging position, the release position and the engaging position are respectively disposed nearby the cable side and the jack side; the engaging portion engages the assembly frame when the engaging switch is switched from the release position to the engaging position to push and support the engaging portion protruding out of the top housing at a side of the engaging portion opposite to the assembly frame;

at least one shaft disposed on one end of the bottom housing adjacent to the jack side; and at least one shaft hole, wherein the at least one shaft hole, which corresponds to the at least one shaft and is disposed on one end of the top housing adjacent to the jack side, and the top housing and the bottom housing pivotally open or close with the at least one shaft as the pivotal center.

19. A data cabling jack device for configuring a plurality of cables on an assembly frame, comprising:

a top housing and a bottom housing, wherein the top housing closes the bottom housing to form an accommodation space, the bottom housing comprises a jack side and a cable side opposite to the jack side and comprises:

at least one supporting holder disposed on the accommodation space, wherein each supporting holder has a suspension arm and a holder connecting the suspension arm, the holder is connected with a suspension end of the suspension arm, and the suspension arm is bent to extend out from an inner bottom surface of the bottom housing to form the holder on the suspension end;

an engaging structure disposed on the top housing and having an engaging switch and an engaging portion, wherein the engaging switch is switched between a release position and an engaging position, the release position and the engaging position are respectively disposed nearby the cable side and the jack side; the engaging portion engages the assembly frame when the engaging switch is switched from the release position to the engaging position to drive the engaging portion protruding out of the top housing;

at least one shaft disposed on one end of the bottom housing adjacent to the jack side; and at least one shaft hole, wherein the at least one shaft hole, which corresponds to the at least one shaft and is disposed on one end of the top housing adjacent to the jack side, and the top housing and the bottom housing pivotally open or close with the at least one shaft as the pivotal center.

20. A data cabling assembly structure, comprising:

an assembly frame having a plurality of engaging holes;

a plurality of cables, wherein each cable has an electrical end; and the data cabling jack device of claim 1, wherein the engaging portions are engaged on the corresponding engaging holes, and the electrical end of each cable is inserted into the accommodation space from the cable end, and the cables are disposed on the accommodation space.

21. The data cabling assembly structure of claim 20, wherein the cables are disposed on the accommodation space in a matrix manner.

* * * * *